US009452509B2

(12) United States Patent
Hung et al.

(10) Patent No.: US 9,452,509 B2
(45) Date of Patent: Sep. 27, 2016

(54) SAPPHIRE PAD CONDITIONER

(71) Applicant: Taiwan Semiconductor Manufacturing Company, Ltd., Hsin-Chu (TW)

(72) Inventors: Jung-Lung Hung, Hsinchu (TW); Chi-Hao Huang, Zhunan Township (TW); Jaw-Lih Shih, Jhudong Township (TW); Hong-Hsing Chou, Jhubei (TW); Yeh-Chieh Wang, Hsinchu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 205 days.

(21) Appl. No.: 13/930,404

(22) Filed: Jun. 28, 2013

(65) Prior Publication Data

US 2015/0004787 A1 Jan. 1, 2015

(51) Int. Cl.

| | |
|---|---|
| ***H01L 21/302*** | (2006.01) |
| ***B24D 18/00*** | (2006.01) |
| ***B24B 53/017*** | (2012.01) |
| ***B24B 53/12*** | (2006.01) |
| ***B24D 5/00*** | (2006.01) |

(52) U.S. Cl.

CPC ..... *B24D 18/00* (2013.01); *B24B 53/017* (2013.01); *B24B 53/12* (2013.01); *B24D 5/00* (2013.01); *B24D 18/0018* (2013.01)

(58) Field of Classification Search

None

See application file for complete search history.

(56) References Cited

U.S. PATENT DOCUMENTS

| | | | | |
|---|---|---|---|---|
| 6,949,016 | B1 * | 9/2005 | de la Llera et al. | 451/285 |
| 2009/0325472 | A1 * | 12/2009 | Wu et al. | 451/443 |
| 2014/0154960 | A1 * | 6/2014 | Lee et al. | 451/443 |

FOREIGN PATENT DOCUMENTS

WO WO 2013012226 A2 * 1/2013

OTHER PUBLICATIONS

Wikipedia, Wikipedia Sapphire, Sep. 28, 2011, Wikipedia, first page.*

Wikipedia, Wikipedia photolithography, Jan. 15, 2012, Wikipedia, first page.*

Chen, Wet and Dry Etching, Apr. 12, 2004, Harvard p. 1.*

Ogiya, H. et al., "Chlorine-Based ICP Etching for Improving the Luminance Efficiency in Nitride LEDs," CS Mantech Conference, Apr. 23-26, 2012, Boston, MASS, 4 pp.

* cited by examiner

*Primary Examiner* — Binh X Tran

*Assistant Examiner* — David Cathey, Jr.

(74) *Attorney, Agent, or Firm* — Slater Matsil, LLP

(57) ABSTRACT

A sapphire pad conditioner includes a sapphire substrate having multiple protrusions on a surface and a holder arranged to hold the sapphire substrate. The sapphire substrate is used for conditioning a chemical mechanical planarization (CMP) pad.

18 Claims, 3 Drawing Sheets

SAPPHIRE PAD CONDITIONER

INCORPORATION BY REFERENCE

A journal article titled "Chlorine-Based ICP Etching for Improving the Luminance Efficiency in Nitride LEDs," by H. Ogiya, et al., published in CS MANTECH Conference in 2012, Boston, Mass., USA, also submitted with IDS of this application, is incorporated herein by reference in its entirety.

TECHNICAL FIELD

The present disclosure relates generally to an integrated circuit and more particularly a pad conditioner.

BACKGROUND

Chemical mechanical planarization (CMP) uses the rough surface of a CMP pad for polishing a wafer to obtain a global planarization of the wafer surface. The roughness of the CMP pad surface affects the removal rate. A pad conditioner used for conditioning the CMP pad removes the accumulated debris and byproduct during the CMP polishing process and also (re-) makes the CMP pad surface rough. However, some pad conditioners have issues with corrosion of bonding material in acidity or alkalinity environment that may lead to some abrasive elements loss.

BRIEF DESCRIPTION OF THE DRAWINGS

Reference is now made to the following descriptions taken in conjunction with the accompanying drawings, in which.

DETAILED DESCRIPTION

Figure 1A:
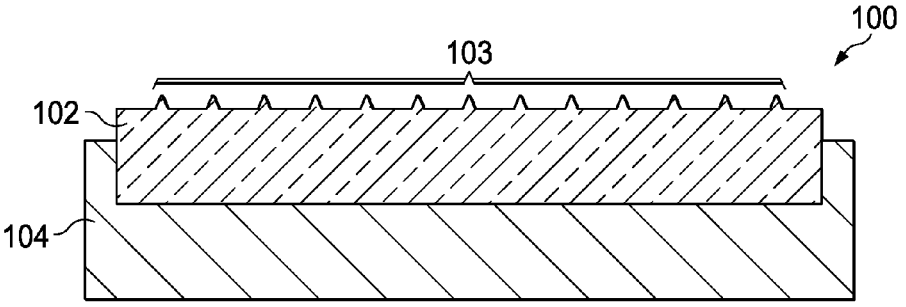
FIGS. 1A-1B are cross section views of an exemplary sapphire pad conditioner according to some embodiments.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

Figure 1B:
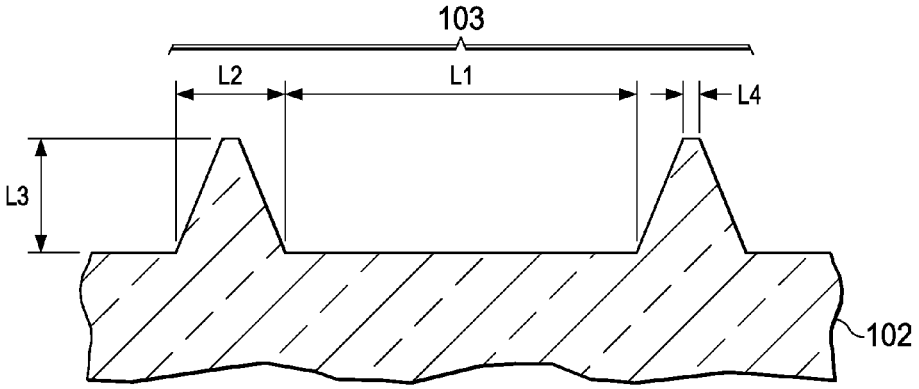

FIGS. 1A-1B are cross section views of an exemplary sapphire pad conditioner 100 according to some embodiments. The sapphire pad conditioner 100 includes a sapphire substrate 102 having multiple protrusions 103 on its surface. The sapphire substrate 102 is used for conditioning a chemical mechanical planarization (CMP) pad (such as 304 shown in FIG. 3). A holder 104 is arranged to hold the sapphire substrate 102 during the CMP process.

The sapphire material has a hardness of 9 in Mohs scale, which is comparable to an industrial diamond's hardness of 9.25. The sapphire substrate 102 is a patterned sapphire substrate (PSS) with the multiple protrusions 103. In some embodiments, the sapphire substrate 102 has a thickness of about 3 mm and has a disk shape with a diameter of about 3.8 inches.

In some embodiments, the holder 104 comprises stainless steel and has a thickness of about 5 mm with a 4 inch diameter in a disk shape. The stainless steel material is resistant to corrosion, rust, or stain. In some embodiments, the sapphire substrate 102 can be placed about 2 mm into the indentation space formed on the holder 104. The size of the sapphire pad conditioner 100 can be different depending on applications.

The multiple protrusions 103 are shown in a close up diagram in FIG. 1B. In some embodiments, the protrusions 103 have a spacing L1 ranging from about 400 μm to about 700 μm in between adjacent protrusions 103. In some embodiments, the protrusions 103 have a width L2 ranging from about 100 μm to about 180 μm, a height L3 ranging from about 50 μm to about 80 μm, and a relatively flat top width L4 ranging from about 2 μm to about 5 μm.

Figure 1C:
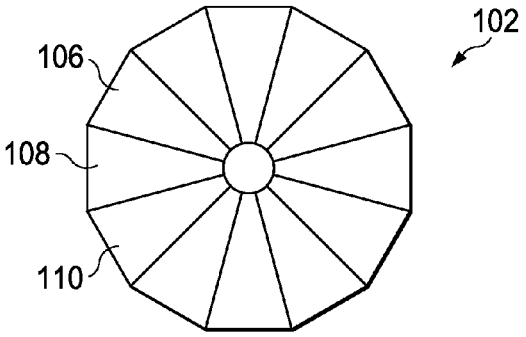
FIG. 1C is a top view of the exemplary sapphire pad conditioner in FIG. 1A with a height distribution map according to some embodiments.

In some embodiments, the protrusions 103 have different heights depending on the location on the sapphire substrate 102. For example, FIG. 1C is a top view of the exemplary sapphire pad conditioner in FIG. 1A with a height distribution map according to some embodiments. The protrusions 103 in a first circular sector 106 have a first height that is different from a second height of the protrusions 103 in a second circular sector 108.

In one example, the protrusions 103 in sections 106 have a protrusion height L3 of about 50 μm, the protrusions 103 in sections 108 have a protrusion height L3 of about 60 μm, and the protrusions 103 in sections 110 have a protrusion height L3 of about 80 μm. In other embodiments, any different mapping shape or scheme can be used for different protrusion height distributions in a predetermined pattern.

The precision of a PSS process for the sapphire substrate 102 is less than 1 μm, compared to a diamond disk leveling precision of about 5 μm-10 μm. Better uniformity and precision can be obtained for the protrusions 103 on the sapphire substrate 102 compared to some other pad conditioners.

Because the protrusions 103 are patterned on the sapphire substrate 102 directly for the sapphire pad conditioner 100, the protrusions 103 are less likely to break off during pad conditioning, which causes a macro scratch issue during a CMP process. In comparison, diamond pieces held together by bonding material are more likely to break off to cause a macro scratch issue during a CMP process. Thus, the sapphire pad conditioner 100 needs less preventive maintenance. With the reduced scratch issue and preventive maintenance, the CMP process efficiency and yield are improved for the sapphire pad conditioner 100.

Figure 2A:
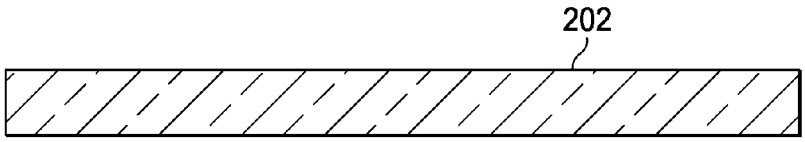
FIGS. 2A-2E are intermediate steps of fabricating the exemplary sapphire pad conditioner in FIG. 1A according to some embodiments.
Figure 2B:
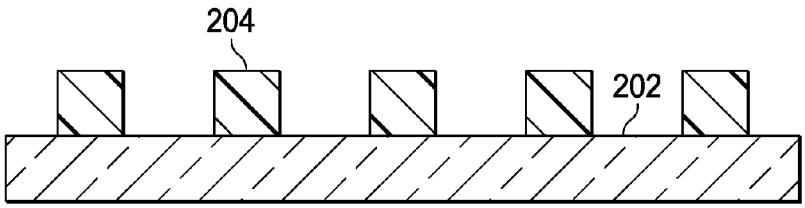

FIGS. 2A-2E are intermediate steps of fabricating the exemplary sapphire pad conditioner 100 in FIG. 1A according to some embodiments. In FIG. 2A, a bare sapphire substrate (or wafer) 202 is shown. In FIG. 2B, a photoresist layer 204 is deposited and patterned over the bare sapphire substrate 202. For example, the photoresist layer 204 can be deposited on the sapphire substrate 202 by coating and patterned by photolithography processes such as aligning a photo mask over the photoresist layer 204 and exposing the photoresist layer 204 to an ultraviolet light.

Figure 2C:
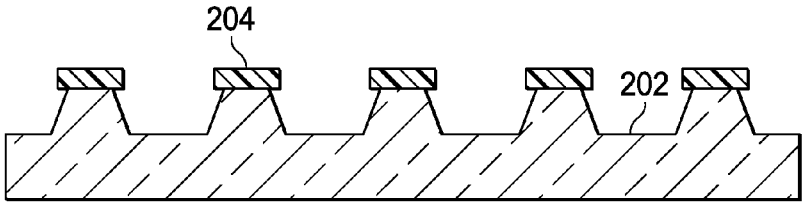
Figure 2D:
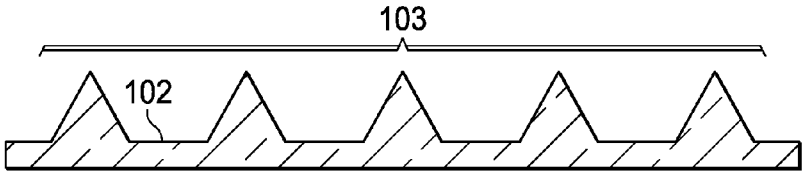

In FIG. 2C, the sapphire substrate is etched and patterned so that the etched sapphire substrate 102 in FIG. 2D has multiple protrusions 103 on its surface. For example, a wet etching technique according to a PSS process known in the art can be used.

Figure 2E:
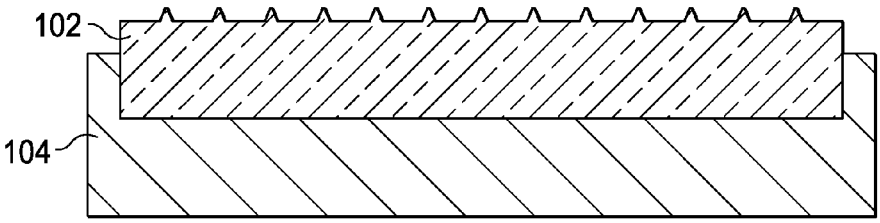

In FIG. 2E, the sapphire substrate 102 is mounted on a holder that is arranged to hold the sapphire substrate 102 while the sapphire substrate 102 is used for pad conditioning in a chemical mechanical planarization (CMP) process. The holder 104 comprises stainless steel in some embodiments.

Figure 3:
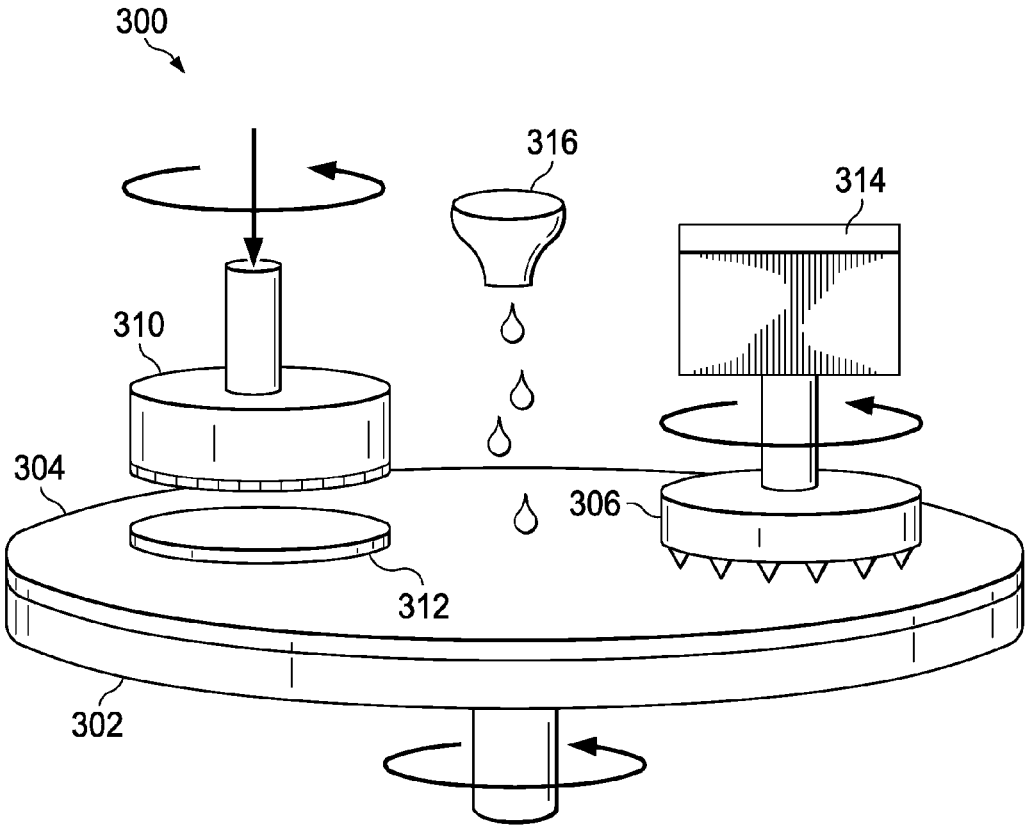
FIG. 3 is a schematic diagram showing a pad conditioning and chemical mechanical planarization (CMP) set up.

FIG. 3 is a schematic diagram showing a pad conditioning and chemical mechanical planarization (CMP) set up. In FIG. 3, a CMP pad 304 is mounted on a platen 302 that is rotated during a CMP process. A sapphire pad conditioner 306 including the sapphire substrate 102 and the holder 104 in FIG. 1A is mounted on a rotator of a pad conditioning module 314. (The sapphire pad substrate 102 has multiple protrusions 103 on its surface as shown in FIG. 1A.) A carrier 310 can hold the wafer 312 and rotate the wafer 312 during the CMP process. A slurry supply 316 provides slurry during the CMP process.

Figure 4:
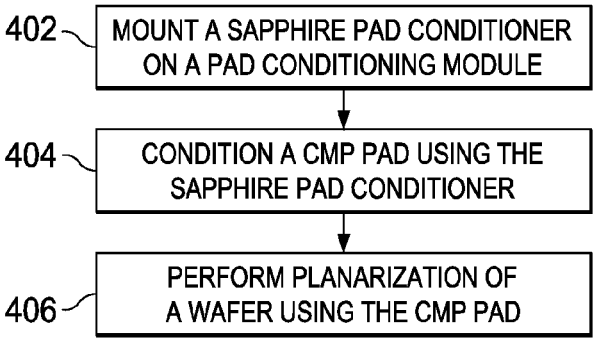
FIG. 4 is a flowchart of a method of pad conditioning and chemical mechanical planarization (CMP) using the set up in FIG. 3 according to some embodiments.

FIG. 4 is a flowchart of a method of pad conditioning and chemical mechanical planarization (CMP) using the set up in FIG. 3 according to some embodiments. At step 402, a sapphire pad conditioner 306 is mounted on the pad conditioning module 314. For example, the sapphire pad conditioner 306 can be fixed to a rotator of the pad conditioning module 314. The sapphire pad conditioner 306 includes the sapphire substrate 102 that has multiple protrusions 103 on a surface and the holder 104 as shown in FIG. 1A. The holder 104 comprises stainless steel in some embodiments.

At step 404, the CMP pad 304 is conditioned using the sapphire pad conditioner 306. For example, the CMP pad 304 is rotated by the platen 302, the sapphire pad conditioner 306 is rotated by the pad conditioning module 314, and the sapphire pad conditioner 306 is lowered towards the CMP pad 304 for conditioning to make the surface of the CMP pad 304 rough and clean of debris and byproducts from a previous CMP process.

At step 406, planarization of the wafer 312 is performed using the CMP pad 304. For example, the CMP pad 304 mounted on the platen 302 is rotated, the wafer 312 mounted on the carrier 310 is rotated and lowered towards the CMP pad 304, and slurry supply 316 provides slurry for the CMP process. With the sapphire pad conditioner 306 that includes the sapphire substrate 102, the CMP efficiency and yield are improved due to reduced scratch issue from debris and broken pad conditioner pieces.

According to some embodiments, a sapphire pad conditioner includes a sapphire substrate having multiple protrusions on a surface and a holder arranged to hold the sapphire substrate. The sapphire substrate is used for conditioning a chemical mechanical planarization (CMP) pad.

According to some embodiments, a method includes depositing a photoresist layer on a sapphire substrate. The photoresist layer is patterned. The sapphire substrate is etched so that the sapphire substrate has multiple protrusions on a surface. The sapphire substrate is mounted on a holder. The holder is arranged to hold the sapphire substrate while the sapphire substrate is used for pad conditioning in a chemical mechanical planarization (CMP) process.

According to some embodiments, a method includes mounting a sapphire pad conditioner on a pad conditioning module. The sapphire pad conditioner has multiple protrusions on a surface. A chemical mechanical planarization (CMP) pad is conditioned using the sapphire pad conditioner.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A method, comprising:

depositing a photoresist layer on a sapphire substrate;

patterning the photoresist layer;

etching a surface of the sapphire substrate so that the sapphire substrate has protrusions on the surface in a first sector and protrusions on the surface in a second sector, wherein the first sector and the second sector each extend from an outer perimeter of the surface of the sapphire substrate to a center portion of the surface of the sapphire substrate, wherein all of the protrusions on the surface in the first sector are a reduced height compared to a height of each of the protrusions on the surface in the second sector; and mounting the sapphire substrate on a holder, wherein the holder is arranged to hold the sapphire substrate while the sapphire substrate is configured to be used for pad conditioning in a chemical mechanical planarization (CMP) process.

2. The method of claim 1, wherein patterning the photoresist layer comprises:

aligning a photo mask over the photoresist layer; and exposing the photoresist layer to an ultraviolet light.

3. The method of claim 1, wherein the holder comprises stainless steel.

4. The method of claim 1, wherein the step of etching the sapphire substrate includes a wet etch process.

5. The method of claim 1, further comprising mounting the holder in a chemical mechanical polish (CMP) tool.

6. The method of claim 1, further comprising contacting the etched sapphire substrate to a CMP pad to condition the CMP pad.

7. The method of claim 1, wherein etching the surface of the sapphire substrate further comprises etching the surface of the sapphire substrate such that all protrusions on the surface in a third sector that extends from an outer perimeter of the surface of the sapphire substrate to a center portion of the surface of the sapphire substrate are a different height compared to the height of each of the protrusions in the first sector and each of the protrusions in the second sector.

8. A method, comprising:

etching a sapphire substrate such that all protrusions on a first sector of a surface of the sapphire substrate have a first height;

etching the sapphire substrate such that all protrusions on a second sector of the surface of the sapphire substrate have a second height, wherein the first and second sectors of the surface extend radially outward from a center portion of the sapphire substrate to an outer perimeter of the sapphire substrate, and wherein the first and second heights are different; and mounting the sapphire substrate on a holder, wherein the surface of the sapphire substrate extends beyond the holder.

9. The method of claim 8, further comprising etching the sapphire substrate such that all protrusions on a third sector of the surface of the sapphire substrate have a third height.

10. The method of claim 9, wherein the first sector of the surface of the sapphire substrate is adjacent the second sector of the surface of the sapphire substrate.

11. The method of claim 9, wherein the third sector extends from an outer perimeter of the surface of the sapphire substrate to a center portion of the surface of the sapphire substrate, and wherein the third sector is adjacent the second sector.

12. The method of claim 8, wherein the first height and the second height ranges from about 50 μm to about 80 μm.

13. The method of claim 8, wherein the holder is configured to be mounted in a chemical mechanical polish (CMP) tool.

14. The method of claim 13, further comprising applying the etched sapphire substrate to a CMP pad to condition the CMP pad.

15. A method comprising:

etching a first surface of a sapphire substrate to have a plurality of protrusions extending from the first surface in each of a first sector, a second sector, and a third sector, wherein all of the plurality of protrusions in the first sector are a first height, all of the plurality of protrusions in the second sector are a second height, and all of the plurality of protrusions in the third sector are a third height, and wherein the first, second, and third heights are different from each other;

mounting a second surface of the sapphire substrate to a mating surface of a holder; and mounting the holder to a chemical mechanical polish (CMP) machine.

16. The method of claim 15, further comprising conditioning a CMP pad using the sapphire substrate mounted in the holder.

17. The method of claim 15, wherein the second sector is positioned between the first and third sectors.

18. The method of claim 15, wherein the etching includes wet etching the top surface to form protrusions having a height from about 50 μm to about 80 μm.

* * * * *